US008141488B2

(12) United States Patent
Görbing et al.

(10) Patent No.: US 8,141,488 B2
(45) Date of Patent: Mar. 27, 2012

(54) METHOD FOR IMPROVED PLATE CHANGE AND SHEET-FED OFFSET PRINTING PRESS HAVING A PLATE CHANGE APPARATUS

(75) Inventors: Christian Görbing, Heidelberg (DE); Martin Grieve, Schriesheim (DE); Alexander Knabe, Heidelberg (DE); Markus Stark, Zuzenhausen (DE); Markus Wolf, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 928 days.

(21) Appl. No.: 12/171,671

(22) Filed: Jul. 11, 2008

(65) Prior Publication Data

US 2009/0013889 A1 Jan. 15, 2009

(30) Foreign Application Priority Data

Jul. 13, 2007 (DE) ..... 10 2007 032 793

(51) Int. Cl.
*B41F 27/12* (2006.01)
*B41F 33/16* (2006.01)

(52) U.S. Cl. ..... 101/477; 101/484; 101/479

(58) Field of Classification Search ..... 101/477, 101/484, 479

See application file for complete search history.

(56) References Cited

U.S. PATENT DOCUMENTS

| | | | |
|---|---|---|---|
| 5,983,793 | A | 11/1999 | Volz et al. |
| 6,053,105 | A | 4/2000 | Rudzewitz |
| 2007/0044671 | A1 | 3/2007 | Knabe |

FOREIGN PATENT DOCUMENTS

| | | | |
|---|---|---|---|
| DE | 198 03 727 | A1 | 8/1999 |
| DE | 10 2005 031 163 | A1 | 1/2007 |
| DE | 10 2006 035 501 | A1 | 3/2007 |
| EP | 0 834 398 | B1 | 4/1998 |

OTHER PUBLICATIONS

German Patent and Trademark Office Search Report, dated Jan. 23, 2008.

*Primary Examiner* — Leslie J Evanisko
(74) *Attorney, Agent, or Firm* — Laurence A. Greenberg; Werner H. Stemer; Ralph E. Locher

(57) ABSTRACT

An apparatus and a method for changing printing plates in sheet-fed rotary printing presses include a plurality of printing units and plate cylinders being coupled to one another mechanically in the printing units during a printing operation. At the beginning of a plate change, the plate cylinders are coupled to one another mechanically and are driven jointly by a main drive motor. After an old printing plate has been conveyed out, each plate cylinder is decoupled from the common mechanical connection and is driven by a separate drive motor.

23 Claims, 6 Drawing Sheets

METHOD FOR IMPROVED PLATE CHANGE AND SHEET-FED OFFSET PRINTING PRESS HAVING A PLATE CHANGE APPARATUS

CROSS-REFERENCE TO RELATED APPLICATION

This application claims the priority, under 35 U.S.C. §119, of German Patent Application DE 10 2007 032 793.7, filed Jul. 13, 2007; the prior application is herewith incorporated by reference in its entirety.

BACKGROUND OF THE INVENTION

Field of the Invention

The present invention relates to an apparatus and a method for changing printing plates in sheet-fed rotary printing presses having a plurality of printing units, in which plate cylinders are coupled to one another mechanically in the printing units during printing operation.

In sheet-fed rotary printing presses, the impression cylinders are coupled to one another mechanically in the individual printing units during printing operation and are driven through a common drive motor. That mechanical coupling has the disadvantage that there is not sufficient flexibility during the plate change of the printing plates, with the result that all of the printing plates have to be conveyed out one after another in a predefined sequence in a manner which is driven by the common mechanical connection, and also have to be inserted again. That leads to the printing plate change taking an unnecessarily long time. Shortening changeover times, in particular during a plate change, is an important aspect, in order to increase the productivity of a sheet-fed rotary printing press. Moreover, the blanket cylinder and impression cylinder have to be washed in the printing press between two print jobs, that is to say during the plate change, in order to remove the printing ink of the old print job. European Patent EP 0 834 398 B1, corresponding to U.S. Pat. No. 5,983,793, has disclosed a sheet-fed rotary printing press, in which the impression cylinders are coupled to one another mechanically in the individual printing units and are driven through a common drive motor. In addition, the plate cylinders in the printing units have switching couplings, by way of which the plate cylinders can be decoupled from the common mechanical connection. In that way, the plate cylinders can be rotated freely with respect to the remaining cylinders. The plate cylinders can be turned through separate drives with respect to the remaining gear train. It is therefore possible to change the printing plates in the printing units at the same time as washing operations are carried out for the blanket cylinders or impression cylinders.

SUMMARY OF THE INVENTION

It is accordingly an object of the present invention to provide a method for improved plate change and a sheet-fed offset printing press having a plate change apparatus, which overcome the hereinafore-mentioned disadvantages of the heretofore-known methods and apparatuses of this general type and which make a reliable plate change possible and at the same time shorten changeover times during a plate change with washing operations on blanket cylinders and impression cylinders.

With the foregoing and other objects in view there is provided, in accordance with the invention, a method for changing printing plates in sheet-fed rotary printing presses having a plurality of printing units with plate cylinders coupled to one another mechanically during a printing operation. The method comprises coupling the plate cylinders to one another in a common mechanical connection and driving the plate cylinders jointly with a main drive motor, at a beginning of a plate change. Each plate cylinder is decoupled from the common mechanical connection and driven with a separate respective drive motor, after conveying out an old printing plate from the plate cylinder.

With the objects of the invention in view, there is also provided a printing press, comprising a plurality of printing units having plate cylinders with printing plates, a main drive motor for the printing units, separate drive motors for the plate cylinders, and a plate changer for changing the printing plates in the printing units. The plate cylinders are coupled to one another in a common mechanical connection in the printing units during a printing operation. The plate cylinders are coupled to one another in the common mechanical connection and driven jointly by the main drive motor at a beginning of a plate change. The plate cylinders are decoupled from the common mechanical connection after conveying out an old printing plate and driven by the separate drive motors.

The present invention can be used in all offset rotary printing presses which have plate cylinders that can be driven individually and can be coupled into a common gearwheel train, with the result that mechanical connections exist between all of the cylinders in the machine during printing operation. This mechanical connection in the form of a gearwheel train is important in order to be able to print with accurate register and registration. The novel type of plate change is distinguished by the fact that, at the beginning of the plate change, the plate cylinders first of all remain coupled to one another mechanically and are driven jointly by a main drive motor of the printing press. As soon as the associated plate cylinder has conveyed its old printing plate out in a printing unit, the plate cylinder is decoupled by a coupling from the mechanical gear train and is driven by an associated separate drive motor. This avoids a situation where first of all the individual plate cylinders have to be decoupled for the plate change and have to be rotated into a decoupling position, with the result that subsequently the plate change is carried out synchronously, as in the prior art. In this case, the plate cylinders instead remain interconnected and in their last relative angular position. For this purpose, the main drive motor rotates the entire gearwheel train including plate cylinders, blanket cylinders, impression cylinders and transport cylinders of the sheet-fed offset printing press slowly backward, with the rear plate edge clamping device in the form of a clamping bar or rail being opened in the corresponding positions of the individual plate cylinders and the old printing plate therefore being pushed in each case into the plate changer. Conveying out can be effected by the blanket cylinders and plate cylinders which continue to be coupled mechanically, with the result that the old printing plates are conveyed out between the two cylinders which roll on one another and are coupled to one another. This type of plate change is particularly robust and reliable in comparison with the plate cylinders in the prior art which are driven individually during conveying out. According to the invention, a total of a maximum of two revolutions of the gearwheel train are sufficient, in order to push all of the old printing plates into the plate changers. Since the plate cylinders are decoupled after the printing plates have been pushed out in the printing units, the washing operations in the printing units can be started immediately. Furthermore, the common mechanical connection during conveying out of the printing plate ensures that the plate cylinder and blanket cylinder move at the same speed, with the result that the old printing plate is conveyed out between the plate cylinders and blanket cylinders which run on one another. This has the great advantage that no separate rubber-covered roll is required for conveying out the printing plate, with the result that cleaning operations of this separate rubber-covered roll are no longer necessary.

In accordance with another feature of the invention, washing operations on the blanket cylinders and/or impression cylinders are performed during the plate change in the printing units. The plate change includes conveying out the old printing plate and feeding and insertion of the new printing plate. During this entire operation or between the insertion of the new printing plate and conveying out of the old printing plate, the blanket cylinders and/or impression cylinders can be washed effectively in a manner which is driven by the separate drive motors. This reduces the changeover time.

In accordance with a further feature of the invention, the respective plate cylinder in the printing units are decoupled from the common mechanical connection when the old printing plate has been pushed from the plate cylinder into the plate changer and has reached the end position. The end position of the printing plate can be sensed by a sensor in the plate changer, which sensor is connected to the control computer of the printing press. As soon as the sensor has detected that the old printing plate is situated in the end position, a signal is output to the control computer of the printing press that the coupling of the respective plate cylinder can be actuated and the plate cylinder can then be decoupled from the gearwheel train and can instead be driven by the separate drive motor. This ensures that the printing plate has been conveyed reliably into the plate changer before switching over to separate operation.

In accordance with an added feature of the invention, the plate cylinder is braked by the separate drive motor after the decoupling of the plate cylinder. The washing operations can be started after decoupling and braking of all of the plate cylinders.

In accordance with an additional feature of the invention, the plate cylinders are coupled into the common mechanical connection again during the washing operation after the insertion of the new printing plate. During the washing operation, the plate cylinders in the printing units are decoupled from the common mechanical connection. In order to shorten the changeover time, the separately driven plate cylinders can be coupled during the washing operation.

In accordance with yet another feature of the invention, the old printing plate is locked against lowering in the printing unit in a plate clamping device of the plate changer after it has been conveyed out. The printing plate is therefore secured against sliding back in the plate changer, with the result that the printing plate can no longer pass back into the printing unit and collide with the plate cylinder or blanket cylinder. The plate clamping device of the plate changer can be produced by a self-locking clamping device, in which a guide roller is pushed upward by that rear plate edge of the old printing plate which is conveyed out. The guide roller clamps the old printing plate against the clamping face as a result of the weight of the old printing plate or an additional spring assistance device, with the result that the old printing plate can only be moved upward due to the shape of the guide track. This avoids the old printing plate sliding backward. It is therefore a self-locking clamping device which permits only one movement direction.

In accordance with yet a further feature of the invention, the above-mentioned self-locking clamping device in the plate changer is distinguished by the fact that, while the plate changer is pushed upward, the old printing plate is driven by the plate clamping device and is pulled out of a plate clamping device for the front edge in the plate cylinder. In order to remove the old printing plate, the plate changer can be pushed upward by the printer in a manner which is assisted by spring force, hydraulic elements or gas pressure springs. While the plate changer is pushed upward, the old printing plate is at the same time also moved upward by the self-locking clamping device and is thus pulled out of the open plate clamping device for the front plate edge in the plate cylinder. The old printing plate is therefore then situated completely outside the plate cylinder.

In accordance with yet an added feature of the invention, a pivotable guide element of the plate changer is pivoted away from the plate cylinder and latched in a largely perpendicular position by the plate changer being pushed upward. The pivoting away of the guide element from the plate cylinder ensures that the old printing plate can no longer pass into the region of the plate cylinder even when the plate changer is pushed downward again by the printer. A collision of the old printing plate with the plate cylinder is therefore avoided reliably even in the case of faulty operation, with the result that the old printing plate can no longer pass into the printing unit but is positioned reliably by the latched guide element. The pivoting away and latching of the guide element is coupled mechanically to the pushing upward of the plate changer, with the result that this operation is configured reliably.

In accordance with yet an additional feature of the invention, a protective device covers the accessible blanket cylinder in the printing units. During changing of the printing plate, the plate cylinder is accessible as a result of the raising of the plate changer and for inserting the new printing plate. Since the adjacent blanket cylinder is likewise accessible, there is the risk that the blanket cylinder which rotates during the washing operations represents a source of risk for the printer who changes the printing plates. In particular, if the printer places the new printing plate into the plate clamping device for the front edge, there is the risk that the printer can come into contact with the rotating blanket cylinders with his or her fingers. This is avoided by a protective device on the blanket cylinder, which protective device can be folded away or retracted and covers the blanket cylinder in such a way that it is not accessible to the printer during the plate change operation. In this way, the safety for the printer is increased considerably during the plate change operation.

In accordance with again another feature of the invention, during the printing plate change, the new printing plates are pulled into the printing units by the separate drive motors of the plate cylinders. The insertion of the new printing plates by the separate drive motors affords the advantage that the blanket cylinders and remaining cylinders in the printing press continue to be available for the washing operation in a manner which is driven by the main drive motor. This means that, while the washing operation is still running, the new printing plates can already be inserted again in a manner which is driven by the separate drive motors. In this way, the changeover time is shortened during the printing plate change.

In accordance with again a further feature of the invention, while they are being inserted, the new printing plates are pressed against the circumferential surface of the plate cylinder by an ironing roll. This ironing roll ensures that the new printing plate lies tightly on the shell of the plate cylinder. The tight contact of the new printing plate on the plate cylinder prevents the printing plate from coming into that region of the blanket cylinder which is still rotating due to the washing operations and thus being damaged by the rotating blanket cylinder. The ironing roll is thus there to protect the new printing plate which is being inserted from the adjacent blanket cylinder during the washing operations which still continue.

In accordance with again an added feature of the invention, as an alternative or in addition, it is possible, while the new printing plates are being inserted, for the speed of the blanket cylinders during the washing operation to be adapted to the insertion speed of the plate cylinders which are driven by the separate drive motors. In this case, the rotational speeds of the separate drive motors and the main drive motor have to be coordinated with one another in such a way that there is no speed difference between the blanket cylinder and the plate cylinder. In this case, an ironing roll can be dispensed with since, if the new printing plate makes contact with the blanket cylinder, it cannot be moved by the blanket cylinder with respect to the plate cylinder and thus be positioned falsely or damaged. As soon as the new printing plate lies on the plate cylinder and is inserted, the speed of the blanket cylinder can be changed again, in order to continue or terminate the washing operation in an unimpeded manner.

In accordance with again an additional feature of the invention, at the end of the insertion operation of the new printing plate, the rear plate edge is pushed through the use of a pressure element into the plate clamping device of the plate cylinder and the plate clamping device is closed. The rear plate edge is positioned reliably in the plate clamping device for the rear edge on the plate cylinder by the extending pressure element, with the result that the plate clamping device for the rear edge can grip the latter reliably and can fasten it on the plate cylinder. To this end, the pressure element is extended briefly in the direction of the plate cylinder and presses the rear plate edge into the plate clamping device which is provided for this purpose on the plate cylinder. After the plate clamping device is closed, the pressure element is thrown off the plate cylinder again, with the result that no more contact is possible between the pressure element and the plate cylinder during further operation.

In accordance with still another feature of the invention, after the plate change, the plate cylinders are coupled into the common mechanical connection again while the main drive motor is rotating. If the plate cylinders are coupled in while the machine is running, the main drive motor does not first of all have to be braked to a standstill, which makes it possible to shorten the changeover time further. In this case, the correct positioning of the plate cylinders with respect to the other cylinders in the mechanical gearwheel train is carried out by corresponding actuation of the separate drive motors of the plate cylinders, with the result that the plate cylinders are coupled into the gearwheel train again in the correct angular position.

In accordance with a concomitant feature of the invention, a sensor checks whether or not the old printing plate is still situated in the plate changer. The pivotable guide elements are controlled by way of this sensor. The pivotable guide elements unlatch again only when the old printing plate has also been removed. This prevents a remaining old printing plate from being placed against the plate cylinders again by the guide elements which pivot back and colliding with the plate cylinders. The guide elements unlatch and are pivoted against the plate cylinders again only when the old printing plate has actually been removed, with the result that the guide elements are ready for the next printing plate change.

Other features which are considered as characteristic for the invention are set forth in the appended claims.

Although the invention is illustrated and described herein as embodied in a method for improved plate change and a sheet-fed offset printing press having a plate change apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
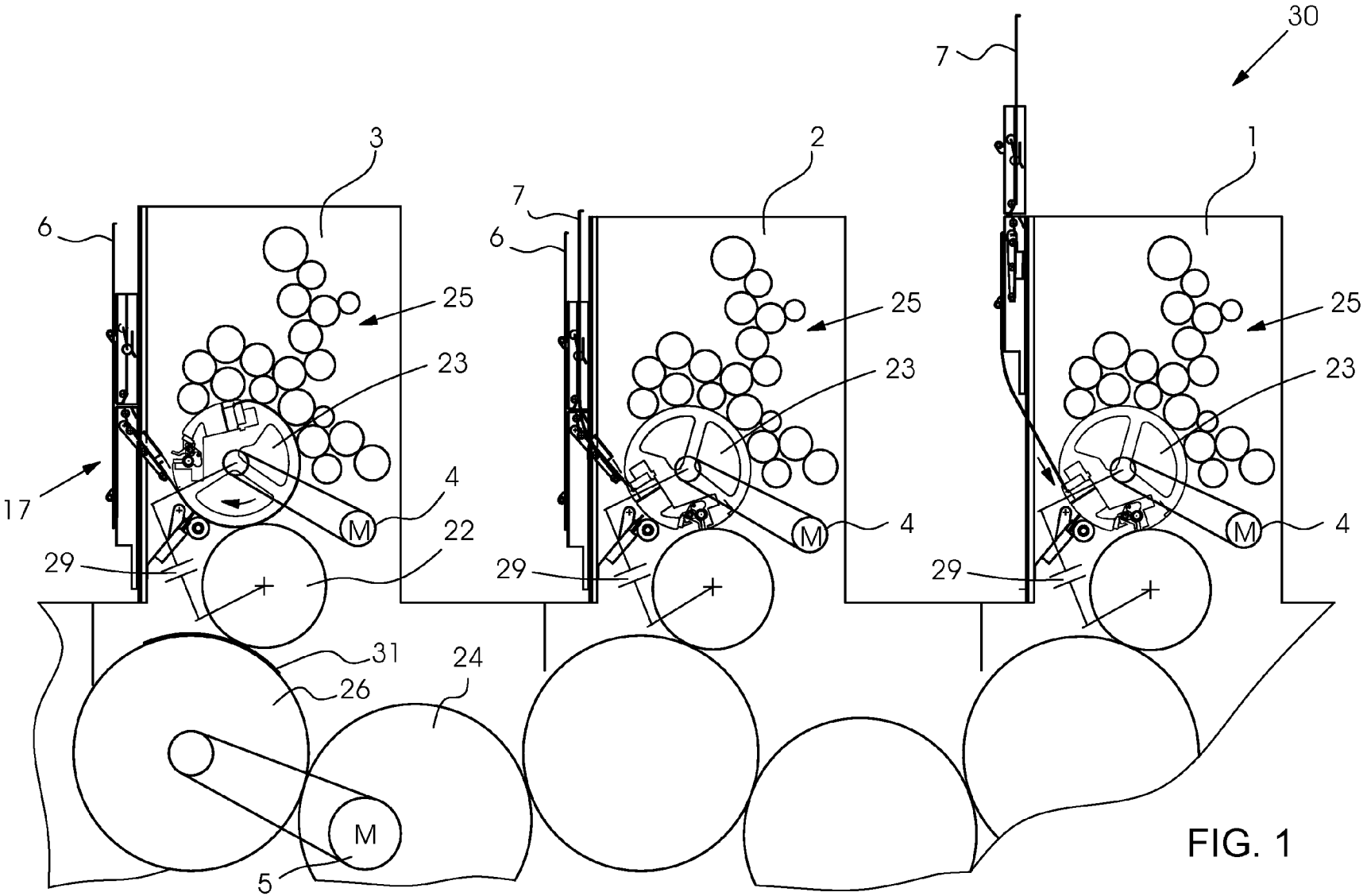
FIG. 1 is a fragmentary, diagrammatic, longitudinal-sectional view of a sheet-fed offset rotary printing press having three printing units at different stages of a plate change.

Referring now to the figures of the drawings in detail and first, particularly, to FIG. 1 thereof, there is seen a sheet-fed offset rotary printing press 30 having three printing units 1, 2, 3. The number of printing units can be varied as desired. Each of the printing units 1, 2, 3 has an inking unit 25 which transfers the printing ink onto a plate cylinder 23 that carries a printing plate 6, 7 with a printing image. The printing image is transferred from the plate cylinder 23 over a blanket cylinder 22 onto a printing material 31 which is printed in a press nip between the blanket cylinder 22 and an impression cylinder 26. The printing materials are moved between the printing units 1, 2, 3 through the use of transport cylinders 24. The impression cylinders 26, the transport cylinders 24 and the blanket cylinders 22 are connected fixedly to one another mechanically through a gearwheel train and are driven by a main drive motor 5. During printing operation, the plate cylinders 23 in the printing units 1, 2, 3 are also driven through the gearwheel train by closing couplings 29 between the plate cylinders 23 and the blanket cylinders 22.

If a print job change is imminent, new printing plates 6 with new color separations have to be pulled onto the plate cylinders 23 and old printing plates 7 have to be removed. To this end, the printing units 1, 2, 3 have a plate changer 17 in each case on the left-hand side. The plate changer 17 receives the old printing plate 7 and provides the new printing plate 6. Moreover, during the printing plate change, the plate cylinders 23 can be decoupled and can be driven independently of the other cylinders 22, 24, 26 through the use of a dedicated drive motor 4. The main drive motor 5 and the separate drive motors 4 are controlled through a non-illustrated machine controller having a corresponding control computer. In FIG. 1, the three printing units 1, 2, 3 are situated in different positions during the plate change. The rear plate edge of the old printing plate 7 is just being released in the printing unit 1, with the result that the old printing plate 7 can be conveyed out. The old printing plate 7 has been removed from the plate cylinder 23 in the printing unit 2, with the result that the old printing plate 7 can then be removed. The plate changer 17 has been raised in the printing unit 3, with the result that the old printing plate 7 has been removed completely from the printing unit 3 and the new printing plate 6 is inserted.

Figure 2:
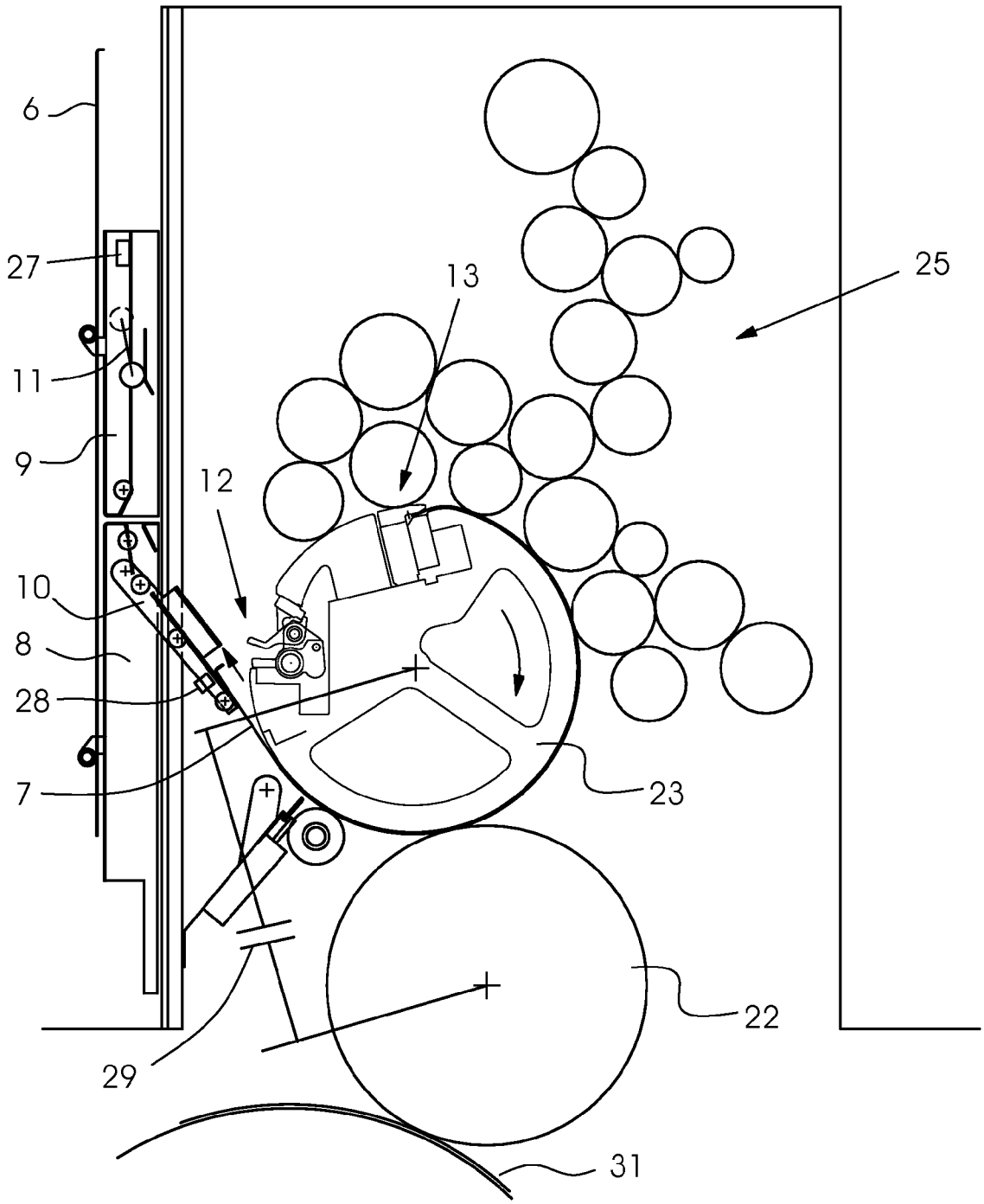
FIG. 2 is an enlarged, fragmentary, longitudinal-sectional view showing an old printing plate being conveyed out of a plate cylinder.

FIG. 2 shows details of the first printing unit 1. It can be seen therein that the plate changer 17 has a lower plate guiding element 8 and an upper plate guiding element 9. A pivotable guide element 10 is situated in the lower plate guiding element 8. The pivotable guide element 10 is provided for guiding the old printing plate 7 away from the plate cylinder 23 over rollers. The plate changer 17 itself is mounted mechanically in such a way that it can be raised and lowered again easily by the operating staff in a manner which is assisted by gas pressure springs or other aids. Moreover, the plate changer 17 carries a sensor 27, by way of which the correct removal of the old plate 7 can be determined. Guide elements having rollers are situated on the outer side of the plate changer 17. The new printing plate 6 is mounted in the guide elements in a manner which is ready for receiving. In order to remove the old printing plate 7, the guide element 10 is pivoted toward the plate cylinder 23, with the result that the old printing plate 7 can slide out on the rollers of the guide element 10. In order to convey the old printing plate 7 out, a rear plate edge plate clamping device 12 on the plate cylinder 23 is opened, with the result that the old printing plate 7 is released from the plate cylinder 23 due to its stiffness and can slide out on the rollers of the pivotable guide element 10. The old printing plate 7 is conveyed out when the blanket cylinder 22 is thrown onto the plate cylinder 23, with the result that the old printing plate 7 is conveyed in the nip between the blanket cylinder 22 and the plate cylinder 23 in the direction of the pivotable guide element 10. A further sensor 28, which is a plate sensor, is attached on the pivotable guide element 10. The machine controller is informed by way of the plate sensor 28 whether the old printing plate 7 has actually been released from the plate cylinder 23 and is not jammed for some reason. While the old printing plate 7 is being conveyed out, the blanket cylinder 22 and the plate cylinder 23 are coupled to one another mechanically and are driven by the continuous gear train through the main drive motor 5. In this case, the plate cylinder 23 moves in the direction of the arrow, with the result that the old printing plate 7 is conveyed into the plate changer 17.

Figure 3:
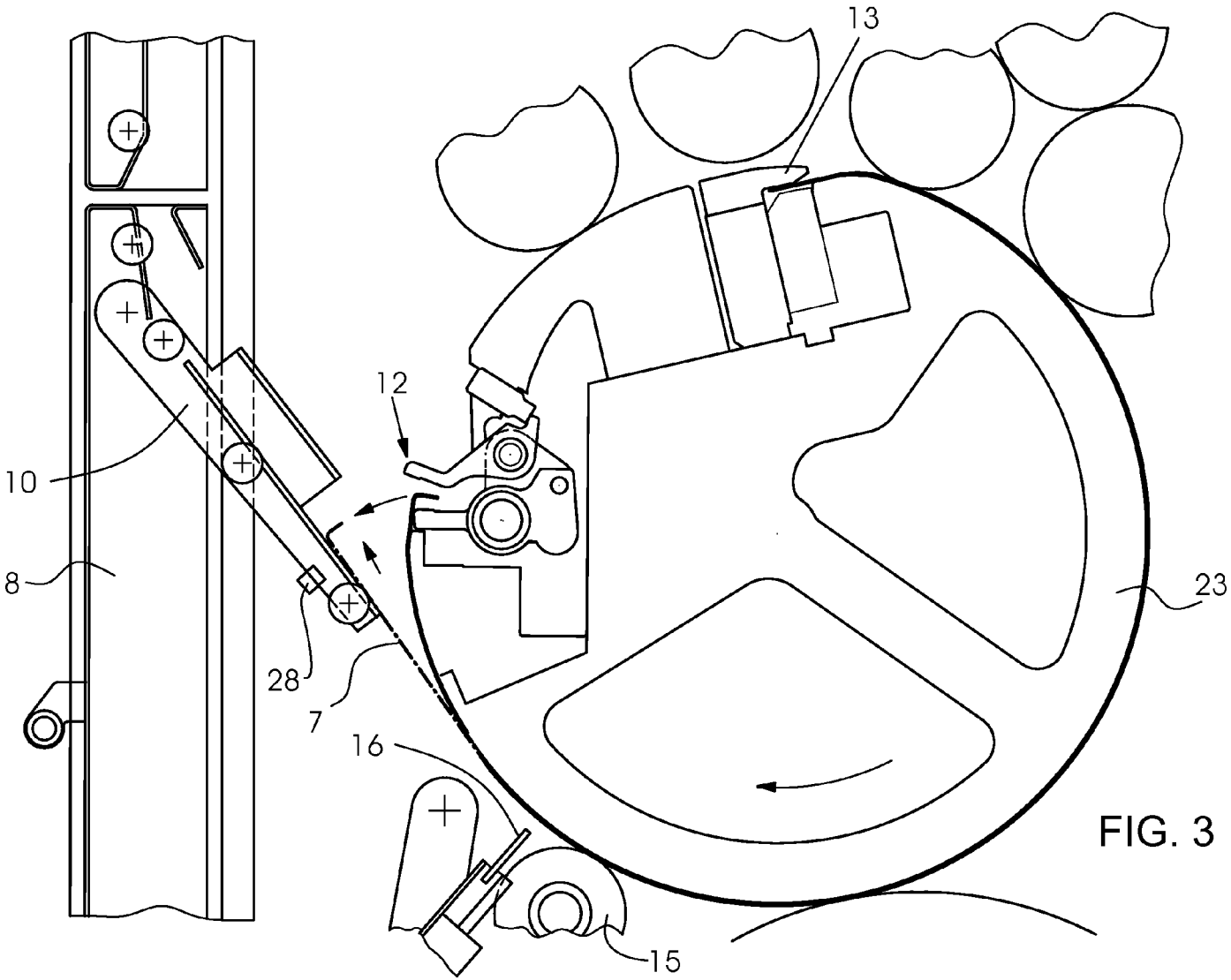
FIG. 3 is a further enlarged, fragmentary, sectional view of the plate cylinder.

The illustration in FIG. 3 shows an enlargement of the region around the plate cylinder 23 in the first printing unit 1. The open rear plate edge plate clamping device 12 can be seen in FIG. 3. The open plate clamping device 12 makes it possible to convey the old printing plate 7 out. In contrast, a plate clamping device 13 on the plate cylinder 23 for a front edge remains closed until the old printing plate 7 has passed the nip between the blanket cylinder 22 and the plate cylinder 23. Moreover, a pressure element 16, which will be required later when clamping in the new printing plate 6, can be seen in FIG. 3.

Figure 4:
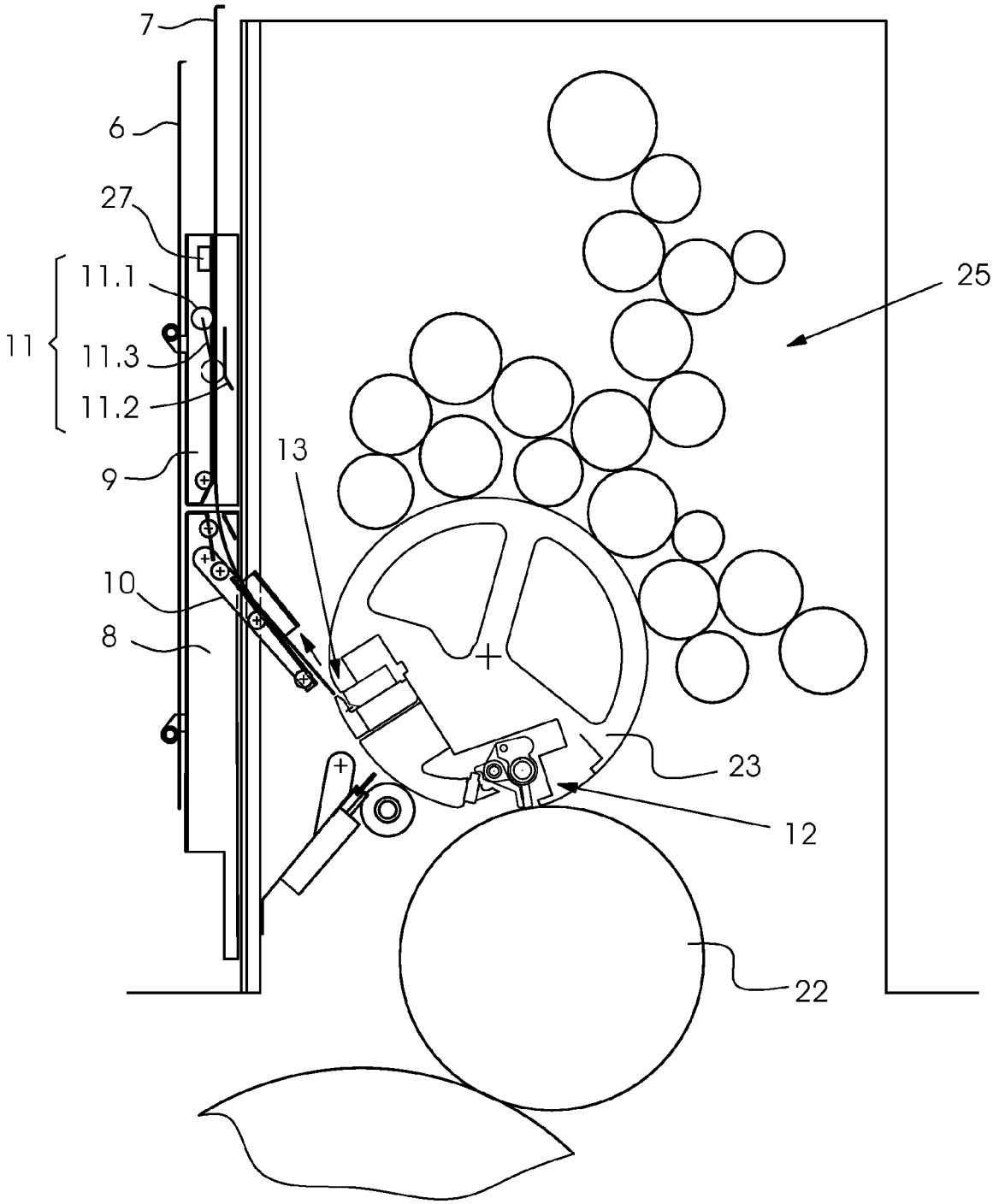
FIG. 4 is a fragmentary, sectional view showing the old printing plate in a state after it has been conveyed out.

In FIG. 4, the old printing plate 7 has been conveyed out of the plate cylinder 23, with the result that only the plate clamping device 13 for the front edge still has to be opened. This end position of the old printing plate 7 which has been pushed out can also be determined through the sensor 27. When this end position has been reached, the control computer opens the mechanical coupling 29 between the plate cylinder 23 and the blanket cylinder 22 and decouples the two cylinders from one another. From this instant, the plate cylinder 23 is driven only through its associated separate drive motor 4. The plate cylinder 23 can therefore then be driven independently of the other cylinders 22, 24, 26 in the gearwheel train. As soon as the plate cylinder 23 is decoupled from the blanket cylinder 22, an accessory position between the plate cylinder 23 and the blanket cylinder 22 is also opened, with the result that the two cylinders are no longer in contact with one another. The process which is described by way of example for the printing unit 1 is likewise performed on the other printing units 2 and 3 one after another.

Furthermore, a plate clamping device 11 which is situated on the plate changer 17 can be seen in FIG. 4. The plate clamping device 11 is configured in such a way that the old printing plate 7 can be pushed in upward only in one direction, with the result that the old printing plate 7 cannot slide back again. This reliably prevents undesired sliding back in the direction of the plate cylinder 23. The plate clamping device 11 includes a clamping roller 11.1, a clamping face 11.2 and a guide track 11.3. While the old printing plate 7 is being conveyed out, the clamping roller 11.1 is pushed upward along the guide track 11.3. The roller 11.1 clamps the old printing plate 7 with respect to the clamping face 11.2 as a result of its weight or an additional assistance in the form of a spring force, with the result that sliding back is prevented reliably. As a result, the old printing plate 7 can only be moved upward.

Figure 5:
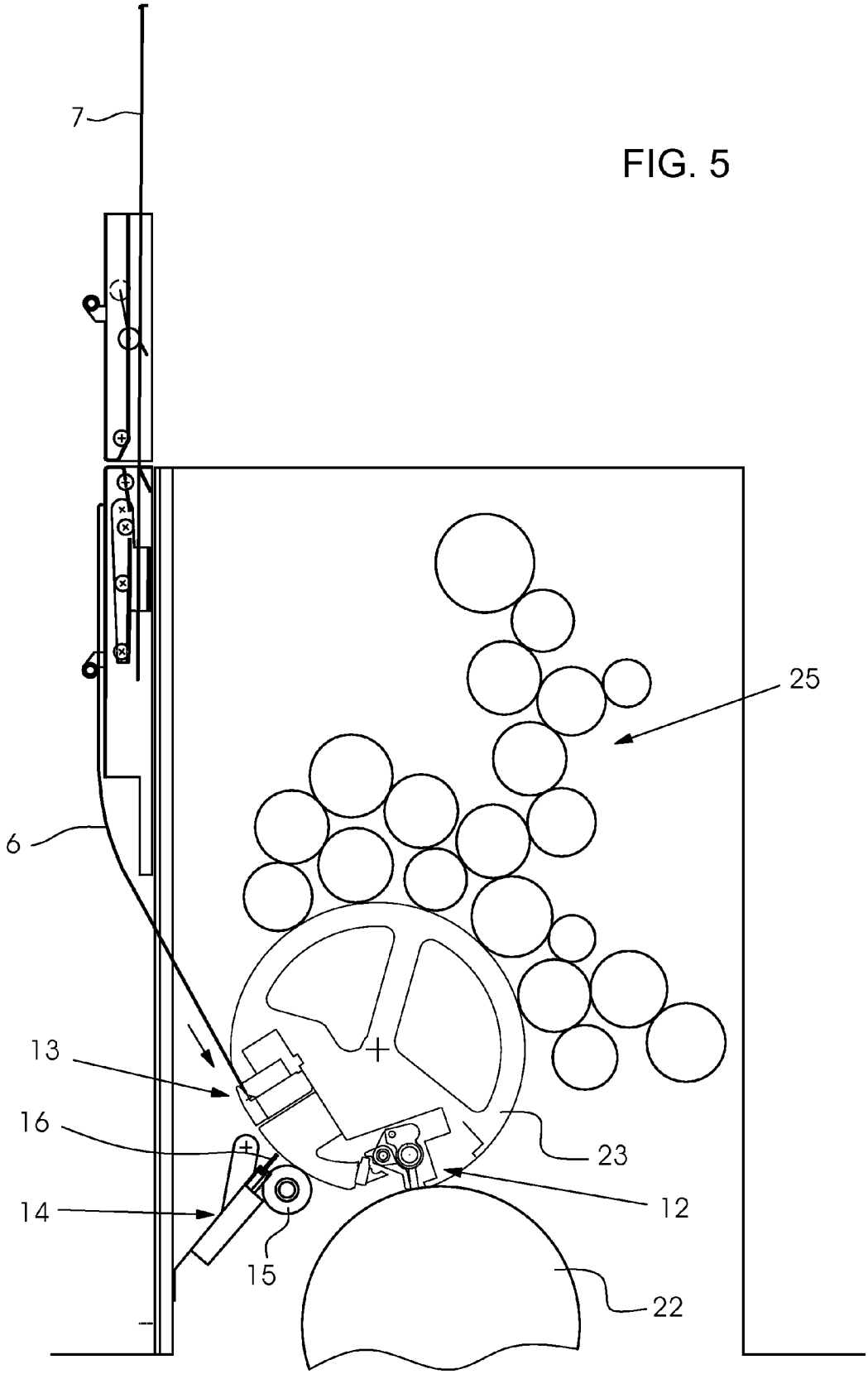
FIG. 5 is a fragmentary, sectional view showing a plate changer in a raised state during insertion of a new printing plate.

Moreover, the plate clamping device 11 on the printing plate changer 17 ensures that the old printing plate 7 is also guided upward when the printing plate changer 17 is raised. FIG. 5 shows the plate changer 17 in this raised position. The operating staff raises the plate changer 17 manually. Moreover, it can be seen that the movable guide element 10 of the lower plate guiding element 8 is pivoted back into the vertical position and latches there when the plate changer 17 is raised. The guide element 10, which is pivoted back, prevents the possibility of the old printing plate 7, which has been pushed out, passing into the region of the plate cylinder 23 if the plate changer 17 with the old printing plate 7 is pushed downward again by the operating staff. Moreover, it can be seen in FIG. 5 that the new printing plate 6, which is situated on the outer side of the plate changer 17, is pushed in the direction of the plate cylinder 23. To this end, an access point is provided for the operating staff. The access point has been opened by the plate changer 17 which has been pushed up. The new printing plate 6 which slides down can then be placed manually on the plate clamping device 13 for the front edge by the operating staff. Since the blanket cylinders 22 can rotate during the entire plate change operation, for example during washing, a protective device 14 is additionally provided which shields the rotating blanket cylinder 22 with respect to interventions by the operating staff. To this end, the protective device 14 is folded automatically in the direction of the plate cylinder 23 when the plate changer 17 is raised, with the result that the blanket cylinder 22 is shielded. Furthermore, the pressure element 16 is fastened to the protective device 14. The pressure element 16 presses the rear plate edge into the plate clamping device 12 for the rear edge after the complete insertion of the new printing plate 6. When the pressure element 16 has pressed the plate in completely and the plate clamping device 12 for the rear edge has closed, the plate change operation is ended. Moreover, the sensor 27 on the plate changer 17 checks whether or not the old printing plate 7 is still situated in the plate changer 17. The pivotable guide element 10 in the printing units 1, 2, 3 unlatches again and pivots again toward the plate cylinder 23 only when the old printing plate 7 has also been removed from the plate changer 17, with the result that the old printing plate 7 can be conveyed out again during the next printing plate change. During the insertion of the new printing plate 6 in FIG. 5, the new printing plate 6 is pressed onto the plate cylinder 23 through the use of an ironing roll 15, with the result that the new printing plate 6 cannot be gripped by the rotating blanket cylinder 22. As an alternative or in addition, it is also possible for the rotational speeds of the decoupled plate cylinder 23, driven by the separate motor 4, and of the blanket cylinder 22, driven by the main drive motor 5, to be adapted to one another through the control computer of the printing press 30 while the new printing plate 6 is being pulled onto the plate cylinder 23. After the new printing plate 6 is also locked at the rear edge by the plate clamping device 12, the plate cylinder 23 can be coupled into the running machine. To this end, the rotational speeds of the plate cylinder 23 and the blanket cylinder 22 are adapted to one another and the coupling 29 between the two cylinders is then closed.

Figure 6:
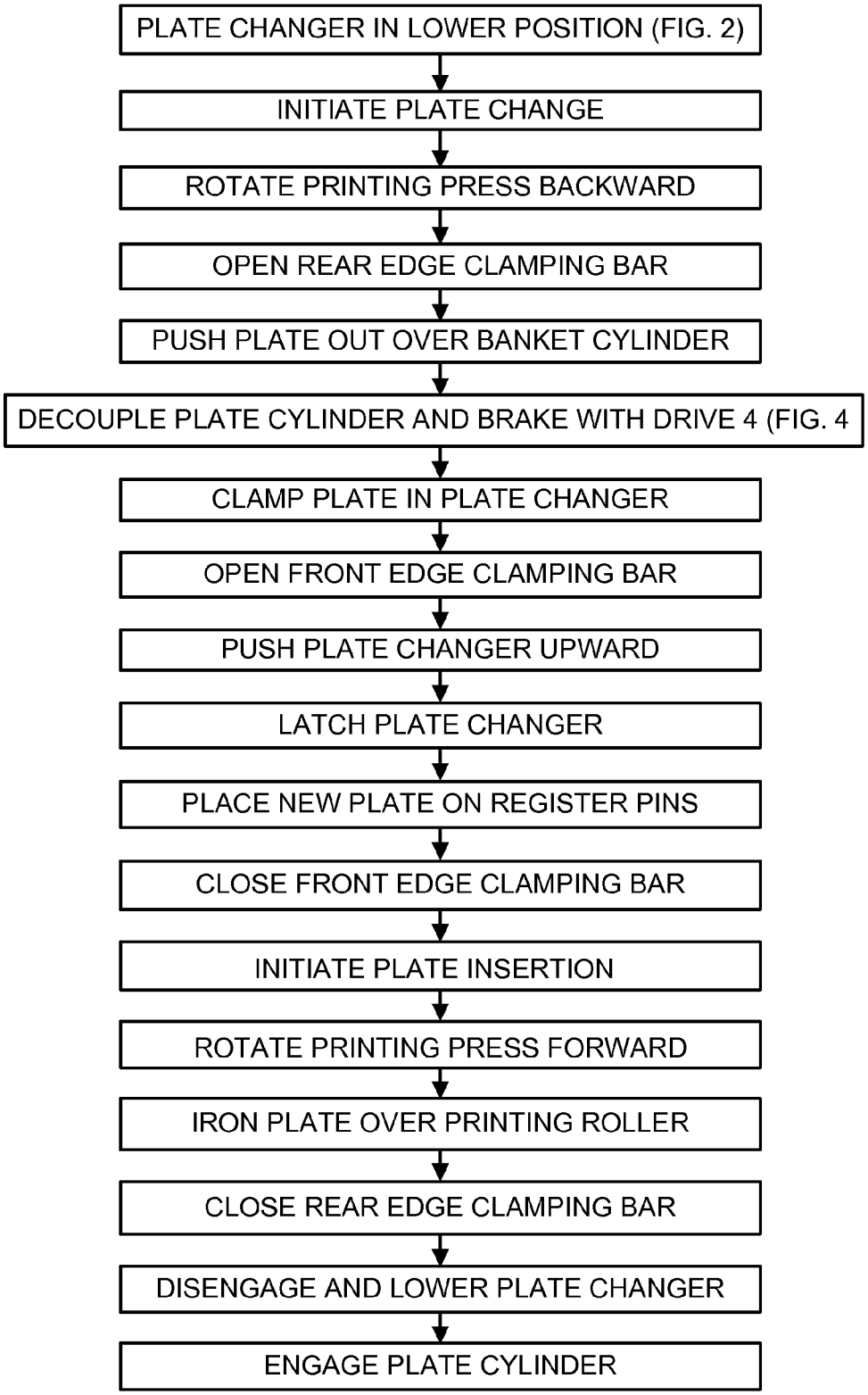
FIG. 6 is a flow chart of the plate change method according to the invention.

The entire operation of the plate change including the washing operations can be gathered from the flow chart in FIG. 6. At the beginning of the plate change, the plate changer 17 is situated in the lower position as shown in FIG. 2. The plate change is initiated by the operator at an operating desk. As a result, the main drive motor 5 of the printing press 30 is braked and begins to rotate backward slowly. In the corresponding positions of the individual plate cylinders 23 in the printing units 1, 2, 3, the plate clamping devices 12 at the rear edge open, as already shown. The old printing plate 7 is then conveyed out between the plate cylinders 23 and the blanket cylinders 22 which roll on one another. As soon as the old printing plate 7 has reached the end position in the plate changer 17, the plate cylinder 23 is decoupled from the main gear train and is braked by the associated drive motor 4. The old printing plate 7 is locked against sliding out in the plate changer 17 through the use of the plate clamping device 11, and the plate clamping device at the front edge 13 on the plate cylinder 23 opens. Subsequently, the operating staff can push the plate changer 17 upward, with the result that the old printing plate 7 is conveyed completely out of the printing unit 1, 2, 3 and, moreover, is prevented against sliding back by the guide element 10 which pivots back in the perpendicular direction. The plate changer 17 latches in the position in which it is pushed upward. The operating staff can then release the new printing plate 6 which is attached laterally to the plate changer 17 and place it onto register pins in the plate clamping device 13 for the front edge. When the new printing plate 6 lies correctly, the plate clamping device 13 at the front edge is closed and the operating staff initiates the plate insertion through an input to the control computer. To this end, the plate cylinder 23 is rotated slowly forward by way of the separate drive motor 4, with the new printing plate 6 being pressed onto the plate cylinder 23 by the ironing roll 15. After complete insertion of the new printing plate 6, the rear edge of the new printing plate 6 is pushed into the plate clamping device 12 for the rear edge through the use of the pressure element 16, with the result that the plate clamping device 12 can close and locks the plate reliably at the rear edge. The plate changer 17 can then be unlatched again by the operating staff and pushed downward. The coupling of the plate cylinders 23 into the mechanical gear train is then performed automatically by the control computer of the printing press 30. In this way, a reliable and rapid plate change operation is made possible which minimizes the changeover time by parallel washing operations.

The invention claimed is:

1. A method for changing printing plates in sheet-fed rotary printing presses having a plurality of printing units with plate cylinders coupled to one another mechanically during a printing operation, the method comprising the following steps:

coupling the plate cylinders to one another in a common mechanical connection and driving the plate cylinders jointly with a main drive motor, at a beginning of a plate change; and decoupling each plate cylinder from the common mechanical connection and driving each plate cylinder with a separate respective drive motor, after conveying out an old printing plate from the plate cylinder.

2. The method according to claim 1, which further comprises conveying the old printing plate into a plate changer by plate cylinders and blanket cylinders rolling on one another.

3. The method according to claim 1, which further comprises performing washing operations on at least one of blanket cylinders or impression cylinders in the printing units during the plate change.

4. The method according to claim 3, which further comprises decoupling the plate cylinders from the common mechanical connection during the washing operation.

5. The method according to claim 3, which further comprises coupling the plate cylinders into the common mechanical connection during the washing operation.

6. The method according to claim 1, which further comprises decoupling the respective plate cylinder in the printing units from the common mechanical connection when the old printing plate has been pushed from the plate cylinder into a plate changer and has reached an end position.

7. The method according to claim 6, which further comprises braking the plate cylinder with the separate drive motor after decoupling the plate cylinder.

8. The method according to claim 1, which further comprises locking the old printing plate against lowering in the printing unit in a plate clamping device of a plate changer after the old printing plate has been conveyed out.

9. The method according to claim 8, which further comprises, while the plate changer is pushed upward, driving the old printing plate with the plate clamping device and pulling the old printing plate out of a plate clamping device for a front edge in the plate cylinder.

10. The method according to claim 8, which further comprises pivoting a pivotable guide element of the plate changer away from the plate cylinder and latching the pivotable guide element in a substantially perpendicular position by the plate changer being pushed upward.

11. The method according to claim 10, which further comprises unlatching and pivoting the pivotable guide element onto the plate cylinder again, after removal of the old printing plate.

12. The method according to claim 1, which further comprises covering an accessible blanket cylinder in the printing units with a protective device.

13. The method according to claim 1, which further comprises, during the printing plate change, pulling new printing plates into the printing units with the separate drive motors of the plate cylinders.

14. The method according to claim 13, which further comprises pressing the new printing plates against a circumferential surface of the plate cylinder with an ironing roll, while the new printing plates are being inserted.

15. The method according to claim 13, which further comprises adapting a speed of a blanket cylinder during a washing operation to an insertion speed of the plate cylinder driven by the separate drive motor, while a new printing plate is being inserted.

16. The method according to claim 13, which further comprises pushing a rear plate edge with a pressure element into a rear plate edge clamping device of the plate cylinder and closing the plate clamping device, at an end of an insertion operation of the new printing plate.

17. The method according to claim 1, which further comprises coupling the plate cylinders into the common mechanical connection again while the main drive motor is rotating, after the plate change.

18. The method according to claim 1, which further comprises checking, with a sensor, if the old printing plate is still situated in a plate changer.

19. A printing press, comprising:

a plurality of printing units having plate cylinders with printing plates;

a main drive motor for said printing units;

separate drive motors for said plate cylinders; and a plate changer for changing said printing plates in said printing units;

means for coupling said plate cylinders to one another in a common mechanical connection in said printing units during a printing operation;

means for jointly driving said plate cylinders being coupled to one another in said common mechanical connection by said main drive motor at a beginning of a plate change; and means for decoupling said plate cylinders from said common mechanical connection and means for driving said plate cylinders by said separate drive motors, after conveying out an old printing plate.

20. The printing press according to claim 19, wherein said plate changer has a pivotable guide element, said guide element being pivoted away from said plate cylinder by pushing said plate changer upward and said guide element being latched in a substantially perpendicular position.

21. The printing press according to claim 19, wherein said plate changer has a clamping device, said clamping device locking the old printing plate against lowering in said printing unit after the old printing plate has been conveyed out.

22. The printing press according to claim 19, wherein said printing unit has an ironing roll, said ironing roll pressing a new printing plate against a circumferential surface of said plate cylinder during insertion.

23. The printing press according to claim 19, wherein said plate changer has a sensor for detecting the old printing plate.

* * * * *